US005205117A

United States Patent [19]

Shekleton et al.

[11] Patent Number: 5,205,117

[45] Date of Patent: Apr. 27, 1993

[54] HIGH ALTITUDE STARTING TWO-STAGE FUEL INJECTION

[75] Inventors: Jack R. Shekleton; Steven A. Sachrison, both of San Diego, Calif.

[73] Assignee: Sundstrand Corporation, Rockford, Ill.

[21] Appl. No.: 649,601

[22] Filed: Feb. 1, 1991

Related U.S. Application Data

[63] Continuation-in-part of Ser. No. 455,519, Dec. 21, 1989, abandoned.

[51] Int. Cl.[5] ..... F02C 3/00; F02C 7/26

[52] U.S. Cl. ..... 60/39.06; 60/39.36

[58] Field of Search ..... 60/39.06, 39.36, 732, 60/733, 746, 748, 738

[56] References Cited

U.S. PATENT DOCUMENTS

| | | | |
|---|---|---|---|
| 2,332,866 | 10/1943 | Müller | 60/746 |
| 2,999,359 | 9/1961 | Murray | 60/733 |
| 3,099,134 | 7/1963 | Calder et al. | 60/746 |
| 3,973,390 | 8/1976 | Jeroszko | 60/39.06 |
| 4,237,694 | 12/1980 | Wood et al. | 60/738 |

OTHER PUBLICATIONS

Baumeister, Theodore "Mechanical Engineer's Handbook", McGraw Hill, New York, 1958, pp. 9-125.

*Primary Examiner*—Richard A. Bertsch
*Assistant Examiner*—Timothy S. Thorpe
*Attorney, Agent, or Firm*—Wood, Phillips, VanSanten, Hoffman & Ertel

[57] ABSTRACT

Difficulties in achieving reliable starts in gas turbine engines operating at high altitude are avoided in a gas turbine engine including a rotary compressor (10), a rotary turbine wheel (12) coupled to the compressor (10) to drive the same, and a nozzle (42) for directing gases of combustion against the turbine wheel (12). An annular combustor (34) has an outlet (40) connected to the nozzle (42) and an opposed dome (38) that is axially spaced from the outlet (40). At least three sets of air injection openings (80, 92, 100) are axially spaced from one another with one set (82) in close proximity to the dome (38). Fuel injectors (86, 94) are associated with two of the sets (80, 92, 100), including the one set (80) and another of the sets (92) that is nearest the one set (80). The air injection openings of the sets (80 and 92) and the fuel injectors (86, 94) are constructed, arranged and sized so that the air/fuel ratio of air injected by each of the sets (80, 92) is no more than about 5/1 and the remaining set of air injection openings (100) is constructed, arranged and sized so that the total air/fuel ratio of air and fuel through all of the sets (80, 92, 100) and fuel injectors (86, 94) is approximately stoichiometric.

6 Claims, 1 Drawing Sheet

FIG. 1
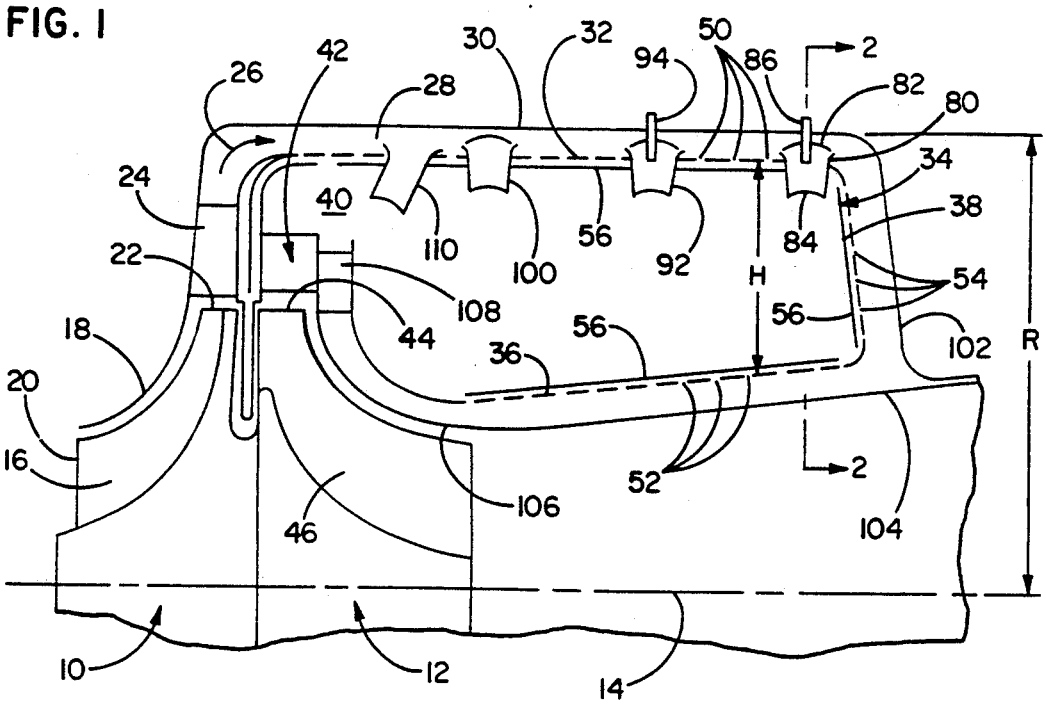
FIG. 2
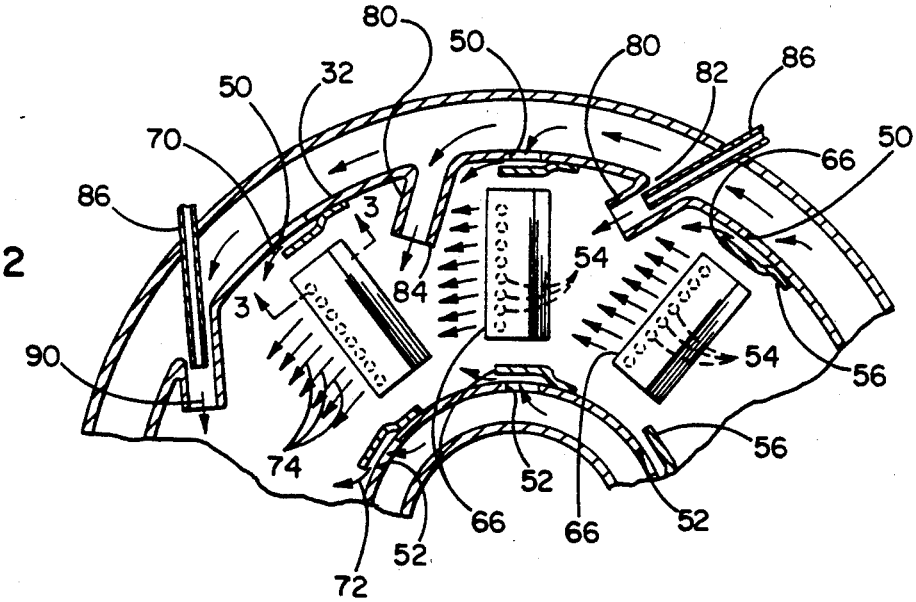
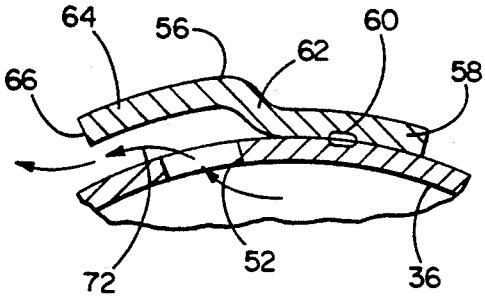
FIG. 3

HIGH ALTITUDE STARTING TWO-STAGE FUEL INJECTION

CROSS REFERENCE

This application is a Continuation-in-Part of our commonly assigned, co-pending application Ser. No. 455,519, filed Dec. 21, 1989 and entitled "Improved Altitude Starting" now abandoned, the details of which are herein incorporated by reference.

FIELD OF THE INVENTION

This invention relates to air breathing gas turbine engines, and more specifically, to method and apparatus for achieving reliable, high altitude starts in such engines.

BACKGROUND OF THE INVENTION

The starting of air breathing gas turbine engines at high altitudes presents substantial difficulties, particularly in the case of relatively small gas turbine engines. At high altitudes, the temperature of the environment is quite cold with the consequence that fuels have high viscosity, making it quite difficult to atomize the fuel sufficiently to ignite properly.

Furthermore, in small gas turbine engines, design constraints restrict the maximum diameter of the engine with the consequence that the frequently used annular combustors have a relatively small dome height, that is, the distance between the radially inner and outer walls of an annular combustor adjacent the radially extending wall or dome opposite from the combustor outlet. Small dome heights require additional injectors to achieve uniform burning to eliminate hot spots. As is well-known, in the operation of gas turbine engines, the higher the altitude, the lower the fuel flow required to maintain any given standard of operation. Consequently, at high altitudes, relatively low fuel flows are required and that in turn means a reduction in the pressure applied to the fuel to achieve the reduced flow rate. Thus, where the turbine fuel injectors are of the pressure atomization type, the lesser fuel pressure utilized at high altitude means insufficient pressure to cause the required degree of atomization necessary to achieve a start. This problem is exacerbated by the need for additional injectors in turbines having low dome heights because as the number of injectors increases, the flow through each decreases and the pressure differential across each is reduced in proportion to the reduction in fuel flow resulting in even poorer atomization.

Moreover, because of the relatively small dome height, gas velocities in the axial direction from the dome toward the combustor outlet are increased for any given volumetric flow rate to the turbine wheel of the engine. This in turn reduces the starting ability of the engine at high altitude as a result of lesser flame stability as well as lesser igniteability.

The present invention is directed to overcoming one or more of the above problems.

SUMMARY OF THE INVENTION

It is a principal object of the invention to provide a new and improved gas turbine engine that may be reliably started at high altitudes as well as a method of starting gas turbine engines reliably at high altitudes.

According to one facet of the invention, the foregoing object is achieved in a method of combusting fuel in an annular combustor for a gas turbine engine so as to permit a reduction in dome height of the combustor without sacrificing flame stability and which includes the following steps:

(a) injecting a first fuel stream into the combustor adjacent the dome thereof while supplying air to the area of the first stream to provide an air/fuel ratio that is sufficiently fuel rich as to result in stable combustion adjacent the dome;

(b) downstream of the dome and upstream of the combustor outlet and in spaced relation to both, injecting a second fuel stream into the combustor while supplying air therewith at a second air/fuel ratio, the second air/fuel ratio being substantially fuel rich; and (c) at a location between the outlet and the location at which step (b) is performed, introducing additional air into the combustor so that the overall air/fuel ratio is approximately stoichiometric.

As a consequence of the foregoing, combustion in the area of the dome is not complete by reason of insufficient air. As a result, axial velocities are reduced to provide for enhanced flame stability.

In one embodiment of the invention, both the first and second air/fuel ratios are approximately equal to one another. In a preferred embodiment, the air/fuel ratios are about 5/1 or less.

The invention further contemplates that the injection of air as part of steps (a) and (b) be primarily by the introduction of air into the annular combustor in the generally circumferential direction.

In one embodiment of the invention, such air is supplied by tangentially oriented air blast tubes.

The invention also contemplates that in some cases, some of the air supplied as a part of at least step (a) be supplied as film cooling air for cooling one or more walls of the combustor. Typically, the film cooling air will also be circumferentially directed.

In addition, air supplied as part of step (c) may be supplied through tangentially directed air blast tubes and in a highly preferred embodiment, the air/fuel ratios of both steps (a) and (b) are both about 3/1. The overall ratio is about 15/1.

The invention also contemplates a gas turbine engine which includes a rotary compressor, a rotary turbine wheel coupled to the compressor to drive the same and a nozzle for directing gases of combustion against the turbine wheel. An annular combustor having an outlet connected to the nozzle and an opposed dome axially spaced from the outlet is provided. At least three sets of air injection openings are provided with the sets being axially spaced from one another and with one set in close proximity to the dome.

Fuel injectors are associated with two of the sets, including the one set adjacent the dome and another of the sets that is nearest the one set. The air injection openings and the fuel injectors of the one and another sets are constructed, arranged and sized so that the air/fuel ratio of air and fuel injected by each of the one and another sets is no more than about 5/1. The remaining set of air injection openings is constructed, arranged and sized so that the total air/fuel ratio of air and fuel through all of the sets and fuel injectors is approximately stoichiometric.

In a preferred embodiment, the air injection openings are generally tangentially oriented with respect to the combustor.

In a highly preferred embodiment, the injection openings are defined by air blast tubes mounted in a radially outer wall of the annular combustor.

The invention also contemplates that the fuel injectors are mounted in some, but not all of the air blast tubes of the one and another sets.

In one embodiment of the invention, at least some of the air injection openings are defined by perforations in at least one wall of the annular combustor to additionally provide for film air cooling of at least the one wall.

Other objects and advantages will become apparent from the following specification taken in connection with the accompanying drawings.

DESCRIPTION OF THE DRAWINGS

FIG. 1 is a somewhat schematic, fragmentary sectional view of a gas turbine engine made according to the invention;

FIG. 2 is a sectional view of the combustor as it would appear if taken approximately along either one of the lines 2—2 in FIG. 1; and FIG. 3 is an enlarged fragmentary sectional view taken approximately along the line 3—3 in FIG. 2.

DESCRIPTION OF THE PREFERRED EMBODIMENT

An exemplary embodiment of a gas turbine engine made according to the invention is illustrated in the drawings and will be described herein in the environment of a radial turbine. However, it is to be understood that the invention may be employed with efficacy in axial turbines as well and is particularly useful where there are design constraints on the overall diameter of the apparatus, the diameter being equal to 2 R, as illustrated in FIG. 1. As alluded to previously, small values of R result in small dome height, the dimension illustrated as H in FIG. 1.

With that in mind, the gas turbine will be described. The same includes a compressor, generally designated 10, coupled by any suitable means to a turbine wheel 12 to be driven thereby about an axis 14. The compressor 10 includes blades 16 in adjacency to a compressor shroud 18. The blades 16 have an inlet ends 20 and outlet tips 22 which discharge compressed gas to a vaned diffuser 24 of conventional construction. Air passing from the diffuser 24 flows in the direction of an arrow 26 into an annular plenum 28 defined by the space between a radially outer housing wall 30 and the radially outer wall 32 of an annular combustor, generally designated 34, concentric with the axis 14.

The annular combustor 34 also includes a radially inner wall 36 concentric with the axis 14 and inwardly of the wall 32 is a radially extending wall or dome 38 which interconnects the walls 32 and 36 at a location opposite from the combustor outlet 40. The combustor outlet 40 is in turn in fluid communication with an annular nozzle, generally designated 42, that is located radially outward of the tips 44 of blades 46 forming part of the turbine wheel 12. As a consequence, hot gases of combustion formed in the combustor 34 exit the same through the outlet 40 and are directed by the nozzle 42 against the turbine wheel 12 to drive the same which in turn drives the compressor 10 in a fashion well-known.

The wall 32, along its length, optionally includes a plurality of perforations 50 in generally axially rows. Similarly, the wall 36 is optionally provided with perforations 52, also in axial rows. The dome or wall 38 optionally includes generally radially extending rows of perforations 54. Overlying each of the rows of holes 50, 52, 54, are flattened S-shaped cooling strips 56 such as illustrated in FIGS. 2 and 3. FIG. 3 illustrates one of the strips 56 that is secured to the radially inner wall 36 of the combustor 34 and is representative of the general configuration employed with the perforations 50 and 54 as well. Each strip 56 includes a base 58 which is secured to the corresponding wall by a spot weld 60 or the like, an intermediate step section 62 and a spaced section 64 terminating in a free edge 66. The free edges 66 are generally transverse to the circumferential direction which is to say the free edges 66 associated with the cooling strips 56 associated with the perforations 50 and 52 extend axially while the free edges 66 associated with the cooling strips 56 for the perforations 54 are generally radially arranged. In any event, the arrangement is such that air entering the interior of the combustor 34 is via the perforations 50 in the wall 32 enters as a film flowing in the circumferential direction as illustrated by an arrow 70; air entering via the perforations 52 is directed circumferentially as a film illustrated by arrow 72 and air entering via the perforations 54 is also directed circumferentially as a film indicated by arrow 74, all to provide film air cooling of the associated combustor wall 32, 36, 38. It will also be observed that in the embodiment illustrated as seen in FIG. 2, the introduction of the circumferential air film through any of the perforations 50, 52 or 54 is counterclockwise which is to say that it is all in the same direction, preferably in the same direction as engine rotation.

Returning now to FIG. 1, mounted in the radially outer wall 32 of the combustor in close adjacency to the dome 38 is a first set of air blast tubes 80. The radially outer end 82 of each tube 80 is located within the plenum 28 while the radially inner end 84 is located within the combustor 34. As can be seen in FIG. 2, the air blast tubes 80 are generally tangentially or circumferentially directed with respect to the space between the walls 32 and 36 with the inner ends 84 directed counterclockwise relative to the outer ends 82. The tubes 80 are equally angularly spaced about the combustor 34 and in the embodiment illustrated, every other one of the air blast tubes 80 is provided with a fuel injecting tube 86. Each of the tubes 86 is also arranged tangentially and thus injects fuel in the circumferential direction through the corresponding air blast tube 80 as illustrated by an arrow 90. In some instances, all of the tubes 80 will be provided with fuel injector tubes 86, but in the usual case, because of the circumferential introduction of both fuel and air, a high degree of circumferential mixing is achieved, allowing a reduction in the number of fuel injectors, even where the dome height H is relatively small.

Downstream of the set of air blast tubes 80 and fuel injection tubes 86 is a second set of air blast tubes, some of which also have fuel injection tubes 94 associated therewith.

The orientation of the air blast tubes 92 and the fuel injections tubes 94 is substantially identical to the construction of the air blast tubes 80 and fuel injection tubes 86 illustrated in FIG. 2, although it should be kept in mind that there is no need or requirement for the tubes 92 to be axially aligned with the tubes 80 as may be inferred from FIG. 1.

Downstream of the air blast tubes 92 is still another set of air blast tubes 100. The tubes 100, like the tubes 80 and 92, are mounted in the outer wall 32 of the annular combustor 34 and directed generally circumferentially. In the usual case, the tubes 100 will not have fuel injecting tubes such as the fuel injecting tubes 86 and 94 associated therewith. Rather, they will inject only air in the circumferential direction.

The radially outer housing wall 30 connects to a radially directed wall 102 which is axially spaced from the dome 38. The wall 102 in turn ties into a radially inner housing wall or exhaust duct 104 which extends toward the turbine wheel 12 to a rear turbine shroud 106. Both the wall 104 and the shroud 106 are spaced from the radially inner wall 36 of the combustor. Thus, a path for cooling air entirely about the combustor 34 is established with cooling air being injected into the outlet 40 through a series of swirler vanes 108 extending between part of the combustor 34 and the nozzle 42. Preferably the cooling air is caused to swirl in the same direction as engine rotation. If desired, an additional set of tubes 110 may be located between the tubes 100 at the outlet 40 for the purpose of directing cooling air onto the interior of the combustor 34 immediately adjacent the outlet 40, but this is an optional configuration.

According to the invention, the fuel injection system for delivering fuel to the fuel injection tubes 86 and 94 along with the air blast tubes 80 and 92 are constructed, arranged and sized so that the air/fuel ratio of air and fuel being injected through the first set of air blast tubes 80 and fuel injection tubes 86 will be no greater than about 5/1 and preferably will be on the order of 3/1. This is to be true whether or not each of the air blast tubes 80 is provided with a fuel injection tube 86 or whether fuel injection tubes 86 are not utilized with all air blast tubes 80 as illustrated in FIG. 2. Consequently, it will be appreciated that a substantially fuel rich (in the stoichiometric sense) air/fuel mixture will be injected for combustion immediately adjacent the dome 38 of the annular combustor.

Similarly, the air blast tubes 92 in the set adjacent the tubes 80 and the injection system for the associated fuel injection tubes 94 will be constructed and arranged and sized to inject a substantially fuel rich mixture (again, in the stoichiometric sense) as well. At this location, again, the air/fuel mixture will be no more than about 5/1 and preferably will be on the order of 3/1. Typically, the same ratios will be used at both above described injection points.

Where film air cooling as is provided by the perforations 50, 52 and 54 is employed, the amount of cooling air entered at that location should be taken into consideration in determining the sizing of the air blast tubes 80 or 92 in that vicinity. That is to say, in the case of air injection in the axial location about a plane embracing the air blast tubes 80, not only the air entering through the tubes 80 must be considered, but the air entering through perforations 54 as well as those perforations 50 and 52 in that area must be taken into account and arriving at the preferred air/fuel ratio. At the axial location embracing the air blast tubes 92, air entering through the perforations 50 and 52 in that general area must be taken into account in a similar fashion.

The air blast tubes 100 in the last set, that is, that nearest the outlet 40 are such as to inject sufficient air that the overall air/fuel ratio is approximately stoichiometric, that is, in the range of 13/1 to 17/1 and nominally 15/1. That is to say, including the air injected through each of the tubes 80, 92 and 100 as well as through the perforations 50, 52 and 54 if present, and the fuel injected through all of the tubes 86 and 94, if not combusted, an air/fuel mixture of 15/1 would exist immediately downstream of the tubes 100.

This construction and mode of operation results in incomplete combustion of the fuel injected through the fuel injection tubes 86 in the area of the dome 34 because of insufficient air. As a consequence, the high velocities that would result had all the fuel there injected been combusted at this area and turned to gaseous products of combustion do not exist with the result that a stable flame to achieve reliable ignition as the turbine comes up to speed is achieved. Further, because the injection is fuel rich at this point in time, at least in relation to the particular area of the combustor, and the fact that the number of injectors may be reduced because of circumferential air and fuel injection and the resultant excellent circumferential mixing, good atomization sufficient to obtain initial ignition is likewise present.

At the same time, full combustion of all fuel is achieved in the vicinity of the air blast tubes 100 and downstream thereof to deliver the full measure of hot gases of combustion to drive the turbine wheel 12 by reason of the ultimate "correction" to a stoichiometric air/fuel ratio thereat.

Thus, the invention provides both a method and an apparatus whereby reliable starting can be achieved, even at high altitude in gas turbine engines. The use of the inventive method and apparatus is particularly advantageous where annular combustors having relatively small dome heights are utilized.

We claim:

1. A method of combusting fuel in an annular combustor for a gas turbine engine so as to permit a reduction in the dome height of the combustor comprising the steps of:

a) injecting a first fuel stream into the combustor adjacent the dome thereof while supplying air to the area of the first stream to provide an air/fuel ration of about 5/1 or less;

b) downstream of the performance of step a), injecting a second fuel stream into the combustor while supplying air to the area of the second stream to provide an air/fuel ratio of about 5/1 or less;

c) downstream of the performance of step b) supplying additional air to raise the overall ratio of air supplied during the performance of steps a), b) and c) to the fuel supplied during the performance of steps b) and c) to about 13/1 to 17/1; and wherein the supplying of air during at least steps a) and b) is primarily achieved by the introduction of air into the combustor in the circumferential direction; and wherein at least part of the air supplied as part of step a) is supplied through tangentially directed air blast tubes.

2. The method of claim 1 wherein some of the air supplied as part of step a)is supplied as film cooling air.

3. The method of claim 2 wherein the film cooling air is circumferentially directed.

4. The method of claim 1 wherein the air supplied as part of step c) is supplied through tangentially directed air blast tubes.

5. The method of claim 1 wherein the air/fuel ratios of steps a) and b) are both about 3/1.

6. The method of claim 1 wherein the overall ratio achieved as a result of the performance of step c) is about 15/1.

* * * * *